US005740767A

United States Patent [19]

Kaku et al.

[11] Patent Number: 5,740,767

[45] Date of Patent: Apr. 21, 1998

[54] SCAVENGE CONTROL FOR ENGINE

[75] Inventors: Junichi Kaku; Kimitake Otome, both of Iwata, Japan

[73] Assignee: Yamaha Hatsudoki Kabushiki Kaisha, Iwat, Japan

[21] Appl. No.: 821,092

[22] Filed: Mar. 20, 1997

[51] Int. Cl.[6] ..... F02B 33/04

[52] U.S. Cl. ..... 123/65 W; 123/73 B; 123/73 PP

[58] Field of Search ..... 123/65 PD, 65 V, 123/65 W, 65 P, 73 A, 73 B, 73 PP

[56] References Cited

U.S. PATENT DOCUMENTS

| | | | |
|---|---|---|---|
| 2,075,232 | 3/1937 | Schneider | 123/65 P |
| 2,114,582 | 4/1938 | Venediger | 123/73 A |
| 2,115,657 | 4/1938 | Venediger | 123/73 A |
| 2,119,121 | 5/1938 | Steinlein | 123/73 A |
| 2,190,011 | 2/1940 | Boxan | 123/73 A |
| 2,317,772 | 4/1943 | Huber et al. | 123/73 A |
| 2,477,374 | 7/1949 | Ide | 123/73 A |
| 3,612,014 | 10/1971 | Tenney | 123/73 A |
| 3,687,118 | 8/1972 | Nomura | 123/73 A |
| 4,088,098 | 5/1978 | Rose et al. | 123/73 A |
| 4,176,631 | 12/1979 | Kanao | 123/73 A |
| 4,248,185 | 2/1981 | Jaulmes | 123/73 PP |
| 4,253,433 | 3/1981 | Blair | 123/73 B |
| 4,258,670 | 3/1981 | Thery | 123/73 B |
| 4,287,860 | 9/1981 | Fujikawa et al. | 123/73 A |
| 4,340,015 | 7/1982 | Gonzalez | 123/73 R |
| 4,719,880 | 1/1988 | Schlunke et al. | 123/73 R |
| 4,813,387 | 3/1989 | Prevedel et al. | 123/73 B |
| 4,821,687 | 4/1989 | Iwai | 123/73 PP |
| 4,899,698 | 2/1990 | Thery | 123/73 A |
| 5,398,645 | 3/1995 | Haman | 123/65 PD |
| 5,490,483 | 2/1996 | Tanikake et al. | 123/65 P |

*Primary Examiner*—David A. Okonsky

*Attorney, Agent, or Firm*—Knobbe,Martens,Olson & Bewar LLP

[57] ABSTRACT

A number of embodiments of two-cycle engines employing Schnurle-type scavenging. In addition and in some embodiments, a ramble port is also incorporated so as to introduce a tumble charge into the combustion chamber and reduce the likelihood of fresh charge from exiting from the exhaust port. This tumble charge may be utilized to achieve stratification, and the fuel charge may be delivered to the combustion chamber through the tumble port or in proximity to it. Various arrangements are shown for controlling the amount of scavenge flow to improve stratification and fuel vaporization.

17 Claims, 9 Drawing Sheets

SCAVENGE CONTROL FOR ENGINE

BACKGROUND OF THE INVENTION

This invention relates to a two-cycle engine and more particularly to an improved scavenging system for such engines.

The advantages of two-cycle engines are well known. The primary advantages of a two-cycle engine relative to a four-cycle engine are its simplicity and its potentially higher specific output. Because these engines are primarily ported and because they fire every revolution rather than every other revolution, these results are obtained. However, the necessity for ensuring complete combustion and total scavenging of the engine presents significant problems. In addition, there is always the risk that some of the fresh fuel-air charge will pass out of the exhaust port at the end of the scavenging cycle. Thus, emission control is a problem that is greater with a two-cycle engine generally than with a four-cycle engine.

One highly successful type of scavenging system employed with two-cycle engines is the so-called Schnurle-type scavenging. With this type of scavenging there is provided a pair of main scavenging ports that are positioned on opposite sides of the exhaust port. The scavenging air flow enters the combustion chamber from the scavenging ports and flows generally axially across the cylinder bore and upwardly toward the cylinder head. The charge then crosses the combustion chamber and flows downwardly toward the exhaust port. This type of scavenging is quite effective in that it takes a relatively long time for the fresh air charge to reach the exhaust port, however, there is still a risk that the fresh fuel air charge may exit through the exhaust port.

It is, therefore, a principal object of this invention to provide an improved scavenging system for a two-cycle engine that insures against blow out of the fresh fuel charge.

One difficulty with the Schnurle-type scavenging system is that it provides a relatively large effective flow area into the combustion chamber. Although this is advantageous for high speed performance, low speed performance can deteriorate. That is, the large flow area provided by the side scavenging passages tends to cause the flow velocity to enter the combustion chamber at a low speed when the engine is running at low and mid range.

Because of the relatively slow flow velocity, the fuel that may be introduced along with the intake air, either by way of carburetion or fuel injection, will not become well vaporized. Furthermore, the slow air flow tends to cause slow flame propagation in the combustion chamber at the time of firing which can further deteriorate performance.

A system has been proposed, therefore, wherein there is provided an additional scavenging passage that is configured so as to introduce turbulence in the form of tumble into the combustion chamber. Such a construction is shown in the co-pending application entitled "Two-Cycle" Engine, Ser. No. 08/715,456 filed Sep. 18, 1996 and assigned to the assignee hereof.

As also shown in that application, it is proposed to inject fuel into the combustion chamber either through or in proximity to this turbulence-generating tumble, scavenge passage. This further aids in the fuel vaporization. However, the relatively large flow areas provided by the main scavenge passages still result in the provision of a relatively low air flow velocity under low and mid range performances that can still reduce combustion efficiency and may provide still some problem in connection with blow-by of the fuel mixture.

It is a further object of this invention to provide an improved scavenging system for a two-cycle engine which will not only effectively scavenge the combustion chamber without having the fresh fuel charge pass out of the exhaust port, but which will also introduce adequate turbulence to ensure complete combustion under all running conditions.

It is a still further object of this invention to provide a Schnurle-type scavenging system for an engine wherein the amount of scavenging air flow and its direction can be controlled to promote turbulence and rapid flame propagation under low speeds and low loads.

With Schnurle-type scavenging it is also somewhat difficult to achieve stratification in the combustion chamber. Stratification is, however desirable at lower loads and speeds to insure good fuel economy and exhaust emission control. Stratification permits a total cylinder charging that is less than stoichiometric. A stoichiometric charge can be maintained in proximity to the spark plug at the time of firing to insure ignition.

It is a still further object of this invention to provide a Schnurle-type scavenging system for an engine wherein stratification can be achieved.

SUMMARY OF THE INVENTION

This invention is adapted to be embodied in a two-cycle internal combustion engine having a cylinder block forming a cylinder bore in which a piston reciprocates and which is closed at its opposite end by a cylinder head. An exhaust port is formed in the cylinder bore at one side thereof. A scavenge port arrangement is provided in the cylinder bore in and is configured so as to provide a scavenging air flow that moves generally axially across the cylinder bore upwardly toward the cylinder head, back across the cylinder bore, and then axially down the cylinder bore from the cylinder head toward the exhaust port. Means are provided for controlling the amount and direction of scavenging air flow.

DETAILED DESCRIPTION OF THE PREFERRED EMBODIMENTS OF THE INVENTION

Figure 1:
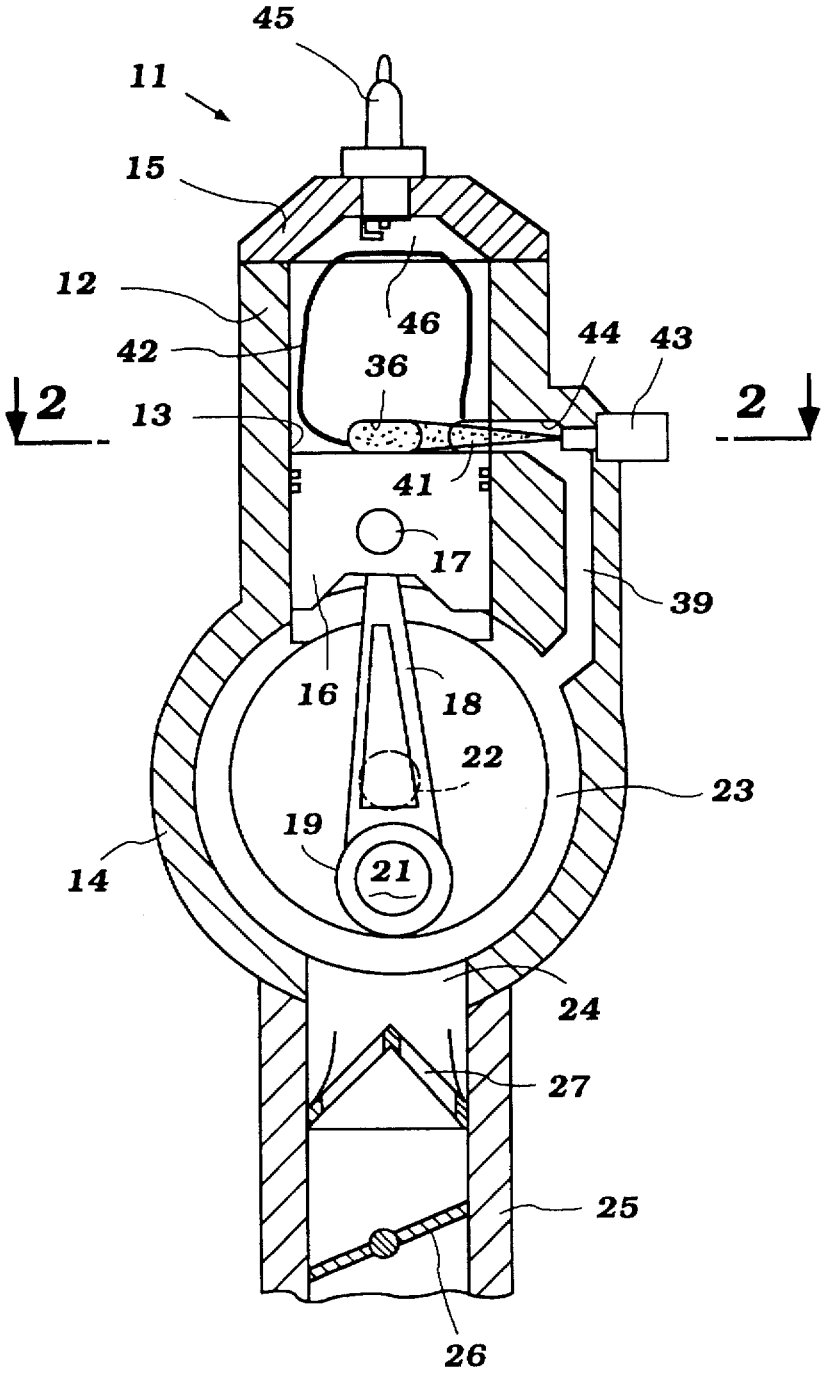
FIG. 1 is a cross-sectional view, taken primarily along the line 1—1 of FIG. 2, through a single cylinder of an internal combustion engine constructed and operated in accordance with an embodiment of the invention.

Referring now in detail to the drawings, and initially to FIGS. 1–6, a two-cycle internal combustion engine constructed in accordance with a first embodiment of the invention is shown in these figures and is identified generally by the reference numeral 11. In the figures showing the engine 11, many of the components are shown in only schematic form. Where any component is so shown, this is because those components are primarily conventional and any prior art type of construction may be employed for them. As should be apparent from the foregoing description, the invention relates primarily to the scavenging system for the engine 11. Therefore, other components of the engine 11, which are not primarily related to the scavenging system, have been either shown schematically, only partially, or not at all. Where that is the case, those skilled in the art can readily resort to any known construction.

The invention also is depicted in conjunction with only a single cylinder of a multiple-cylinder internal combustion engine. Again, those skilled in the art will readily understand how the invention may be practiced with multiple-cylinder engines of any configuration.

The engine 11 is comprised of a cylinder block 12 that is formed with at least one cylinder bore 13. The lower end of the cylinder bore 13 is closed by the skirt of the cylinder block 12 and a crankcase member 14. The opposite end is closed by a cylinder head assembly 15 that is affixed to the cylinder block in any known manner. This may also include engines wherein the cylinder block 12 and the cylinder head 15 are integrally formed.

A piston 16 reciprocates in the cylinder bore 13 and is connected by means of a piston pin 17 to the small or upper end of a connecting rod 18. The lower or big end 19 of the connecting rod 18 is journaled on a throw 21 of a crankshaft 22. The crankshaft 22 is rotatably journaled in a crankcase chamber 23 that is formed by the cylinder block and crankcase member 14. If a multiple-cylinder engine is employed, the crankcase chamber 23 associated with each cylinder bore 13 is preferably sealed from the others.

An induction system supplies an air charge to the crankcase chamber 23 through an intake port 24 formed in the crankcase member 14. This induction system includes a throttle body 25 in which a flow-controlling throttle valve 26 is positioned. The throttle valve 26 is connected in an appropriate manner to a suitable throttle actuator.

A reed-type check valve assembly 27 is interposed between the throttle valve 26 and the intake port 24, and is preferably in close proximity to the intake port 24. The reed-type check valve 27 permits the air flow to enter the crankcase chamber 23 when the piston 16 is moving upwardly in the cylinder bore. However, as the piston 16 moves downwardly to compress the charge in the crankcase chamber 23, the check valve 27 will close so as to permit this compression to take place and to prevent reverse flow through the induction system.

A scavenging system is provided for transferring the charge which has been compressed in the crankcase chamber 23 to the combustion chamber formed by the head of the piston 16, the cylinder bore 13, and the cylinder head 15. This charge is then further compressed in the combustion chamber as the piston 16 continues its upward stroke toward the cylinder head 15.

This scavenging system includes a pair of main scavenge passages 28 and 29 that are formed in the cylinder block 12 on opposite sides of an exhaust port, to be described later, and which extends from an inlet openings in the crankcase chamber 23 to scavenge ports 30 and 31 that open through the cylinder bore 13. These scavenge passages 28 and 29 and the scavenge ports 30 and 31 are configured so as to create a flow pattern in the combustion chamber, indicated by the shaded arrows 32 in FIG. 5. This flow moves generally axially toward the cylinder head 15 along the side of the cylinder bore 13, across the cylinder bore axis, and then downwardly toward an exhaust port 33 formed in the cylinder bore 13 between the main scavenge ports 30 and 31.

This exhaust port 33 communicates with an exhaust passage 34 that extends through the cylinder block 12 and delivers the exhaust gases to the atmosphere through a suitable exhaust system, which is not shown.

In addition to the pair of main scavenge passages 28 and 29, there is provided a center scavenge passage 35. The scavenge passage 35 is positioned in diametrically opposed relationship to the exhaust port 33 and is configured so as to open into the crankcase chamber 23 at its inlet end. The passage 35 terminates in a center scavenge port 36 which is disposed between the main scavenge ports 30 and 31 and diametrically opposite to the exhaust port 33. This center scavenge passage 35, and its exit scavenge port 36 is configured so as to provide a flow pattern, as indicated by the shaded arrow 38 in FIG. 5, which also flows generally axially along the cylinder bore axis 13 upwardly toward the cylinder head 15. The flow then passes across the cylinder bore toward the side where the exhaust port 33 is formed and then downwardly so as to exit this port.

The construction of the engine 11 as thus far described may be considered to be conventional. In accordance with a feature of the invention, there is provided a ramble scavenge passage 39, which also extends from an inlet end in the crankcase chamber 23 along the axis of the cylinder bore 13 at one side thereof and which exits into the combustion chamber through a tumble port 41. This ramble port 41 and the ramble passage 39 are configured so as to create a flow pattern in the combustion chamber that travels first across the cylinder bore axis toward the opposite side of the cylinder bore, then axially upwardly along the side of the cylinder bore 13 toward the cylinder head 15. This charge then passes back across the cylinder bore and flows axially downwardly back toward the tumble port 41, as seen by the arrow 42 in FIGS. 1, 2 and 5. Hence, this tumble passage 39 and tumble port 41 create turbulence in the combustion chamber and a flow which is generally not directed toward the exhaust port 33.

This flow may also somewhat cause a skew to the flow action from the center scavenge passage 36 and the side scavenge passages 30 and 31 so as to further improve the tumbling action and the turbulence in the combustion chamber, particularly at low speeds.

In accordance with one embodiment of the invention, a fuel injector 43 is mounted in the side of the cylinder block 12 so as to have a spray pattern that flows into an intermediate portion 44 of the tumble passage. This fuel mixes with the air flowing through the ramble passage 39 and port 41 so as to improve fuel mixing in the combustion chamber.

Figure 2:
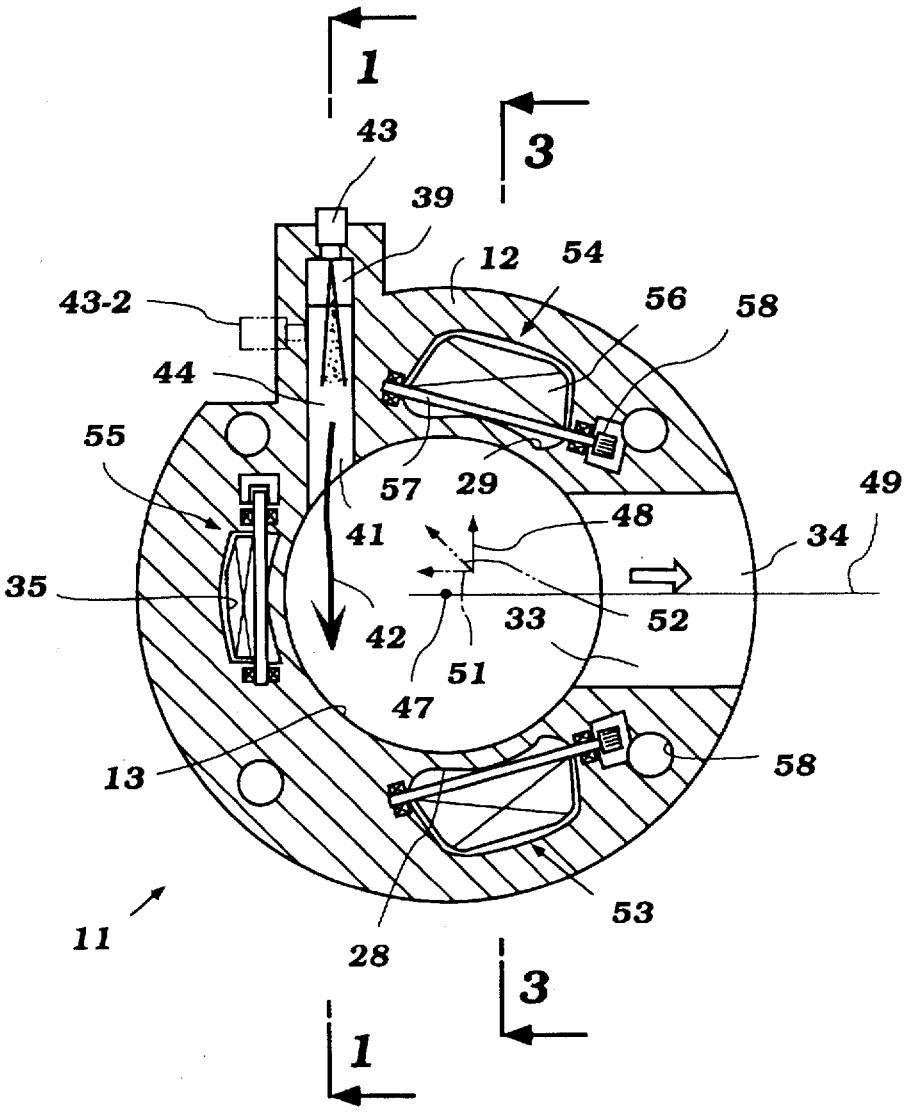
FIG. 2 is a transverse cross-sectional view taken along the line 2—2 of FIG. 1.
Figure 3:
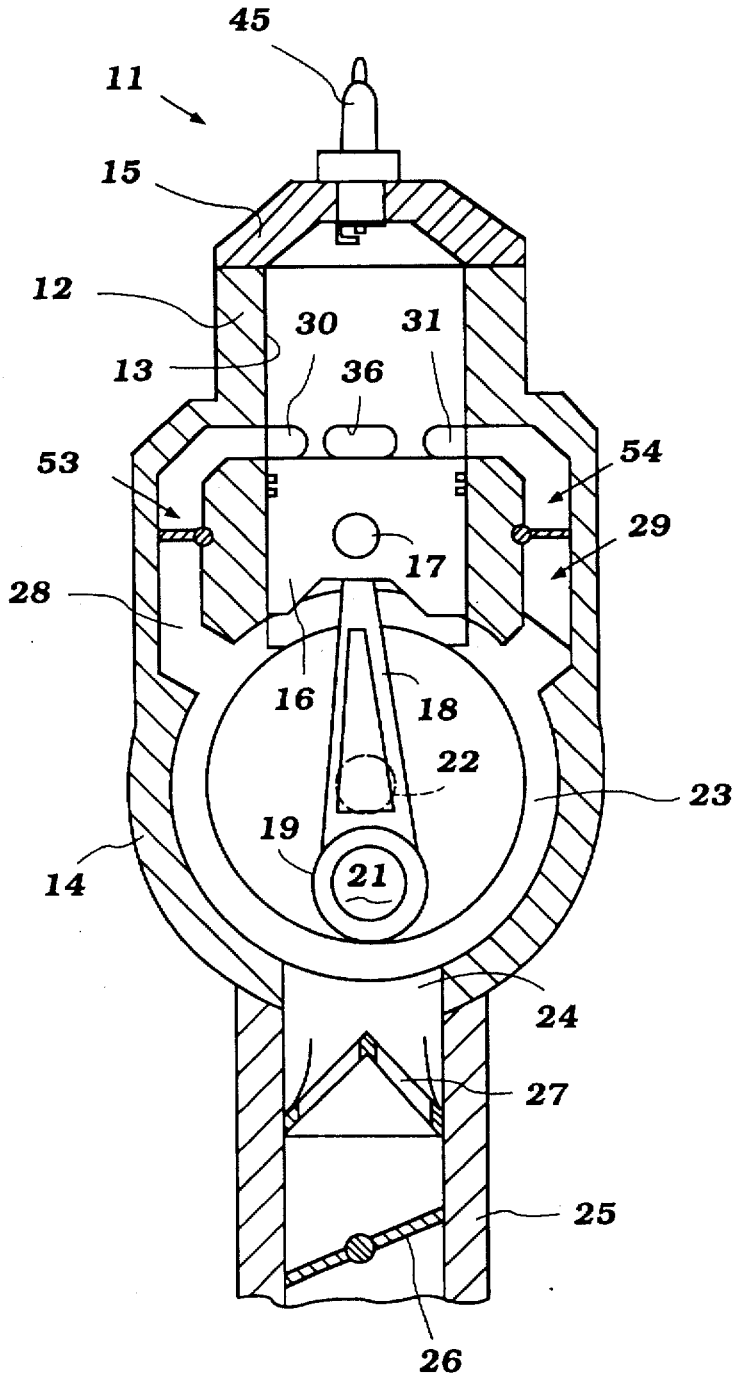
FIG. 3 is a cross-sectional view, taken primarily along the line 3—3 of FIG. 2, and shows the scavenge control valves associated with the main scavenge passages.
Figure 5:
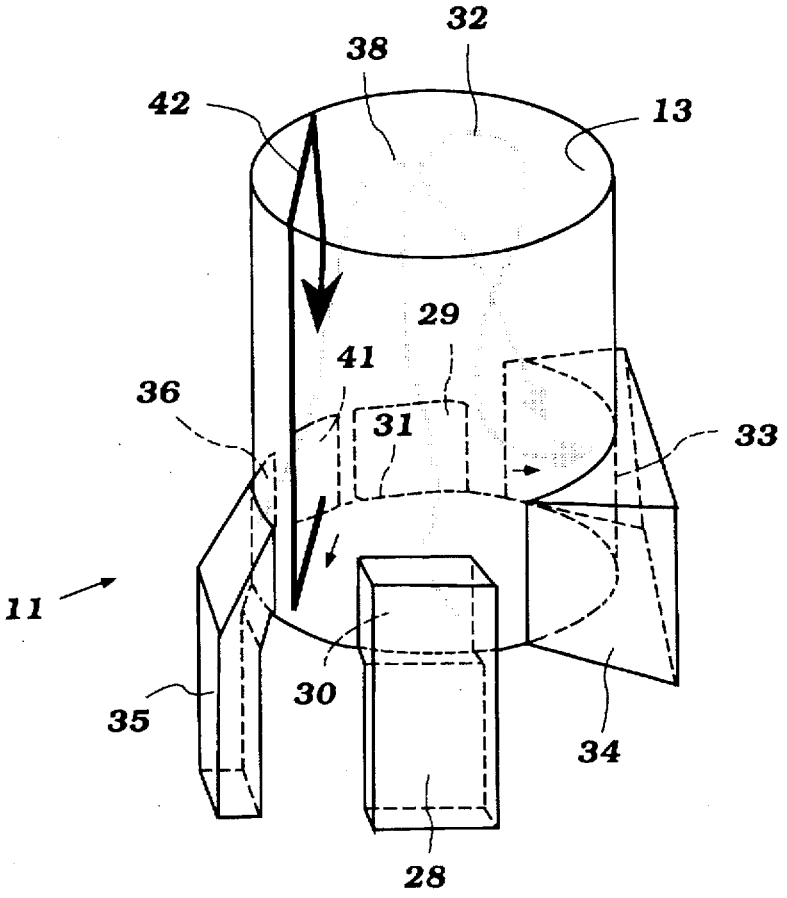
FIG. 5 is a perspective view showing the normal scavenge flow and the flow generated by the added tumble scavenge port.

This fuel pattern is also shown in FIGS. 1, 2 and 5 by the same shaded line 42. The resulting flow pattern also stratifies the mixture in the combustion chamber to form a richer and stoichiometric charge in proximity to a spark plug 45 mounted in the combustion chamber recess 46 cylinder head 15. Also since this flow is not directed toward the exhaust port 36, fuel is not likely to escape from the cylinder bore 13 before it has burned.

Alternatively, the fuel injector may be mounted at the location 43-2, which is transversely disposed to the ramble passage portion 44, and thus will still be intersected by the flow pattern 42 to promote homogenous mixing of the fuel charge and/or stratification under some running conditions in proximity to the spark plug 45 that is mounted in the cylinder head 15 and which is fired in a known manner. As a result, there will always be a stoichiometric mixture present at the gap of the spark plug 45 at the time of ignition, and thus lean-burn running can be accomplished under low-speed, low-load conditions.

Figure 4:
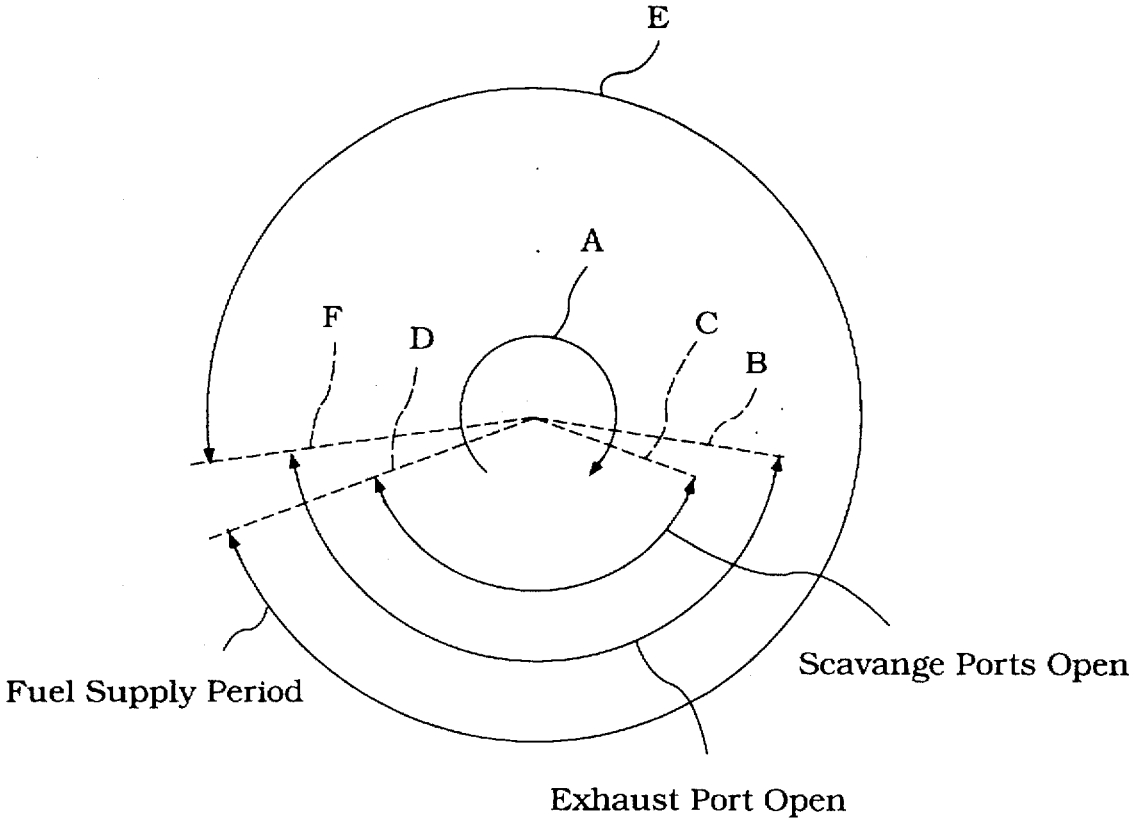
FIG. 4 is a timing diagram showing the timing of the various events and flow conditions.

FIG. 4 shows the timing events for this embodiment. The events are, however, basically the same for all embodiments. The direction of rotation is shown by the arrow A. The exhaust port 32 is opened by the movement of the piston 16 at the crank angle B. The scavenge ports 30, 31, 36 and 41 all open at the crank angle C and then close at the angle D. At any time during this rotation, the fuel injection may occur and the arc E indicates the time when fuel may be injected or otherwise delivered. The exhaust port 33 closes at the crank angle F.

With the arrangement as thus far described, which generally conforms to that shown in aforenoted co-pending application Ser. No. 08/715,456 the flow of the fuel air mixture issuing from the scavenge port 41 tends to move generally toward the cylinder bore axis, indicated by the line 47. The side or main scavenge passages 28 and 29 provide a resulting force vector the magnitude of which is indicated by the arrow 48 that extends perpendicularly to a plane 49 that passes through the cylinder bore axis 47. On the other hand, the scavenge passage 35 creates a vector having a magnitude indicated by the line 51 which tends to cause these scavenge flows to result in a force vector indicated at 52 that tends to cause the flow 41 to be directed generally toward the cylinder bore axis 47.

This improves the homogeneous mixture in the combustion chamber, but under low speed, low load conditions, it increases the likelihood that there will be a passage of some of the fuel flow out of the exhaust port 33. In addition, the flow velocities will be reduced due to the large flow area under low speed and mid range conditions.

Therefore, there is provided a series of scavenge control valves, indicated generally by the reference numerals 53, 54 and 55, which are placed in the scavenge passages 28, 29 and 35, respectively. These scavenge control valves 53, 54 and 55 each are comprised of a valve plate 56 that is fixed to a valve shaft 57 that extends transversely across one side of the respective scavenge passage 28, 29 and 35. A suitable servo motor (not shown) operates with a gear 58 fixed to one end of each of the control valve shafts 57 for positioning the valve plates 56 in either the position shown in FIGS. 2 and 3, wherein the scavenging flow through these passages is substantially restricted or a fully opened position.

Under low speed, low load conditions and the lower end of the mid range, when the scavenge control valves 53, 54 and 55 are substantially closed, there would be a more asymmetric flow of the tumble scavenge passage as indicated by the arrow 44 that tends to congregate around the outer periphery of the cylinder bore and, thus, which will ensure that the fuel will not pass out of the exhaust port 33 under this condition. In addition, there will be a higher velocity air flow surrounding the fuel spray and this will also ensure that the fuel becomes better atomized.

Figure 6:
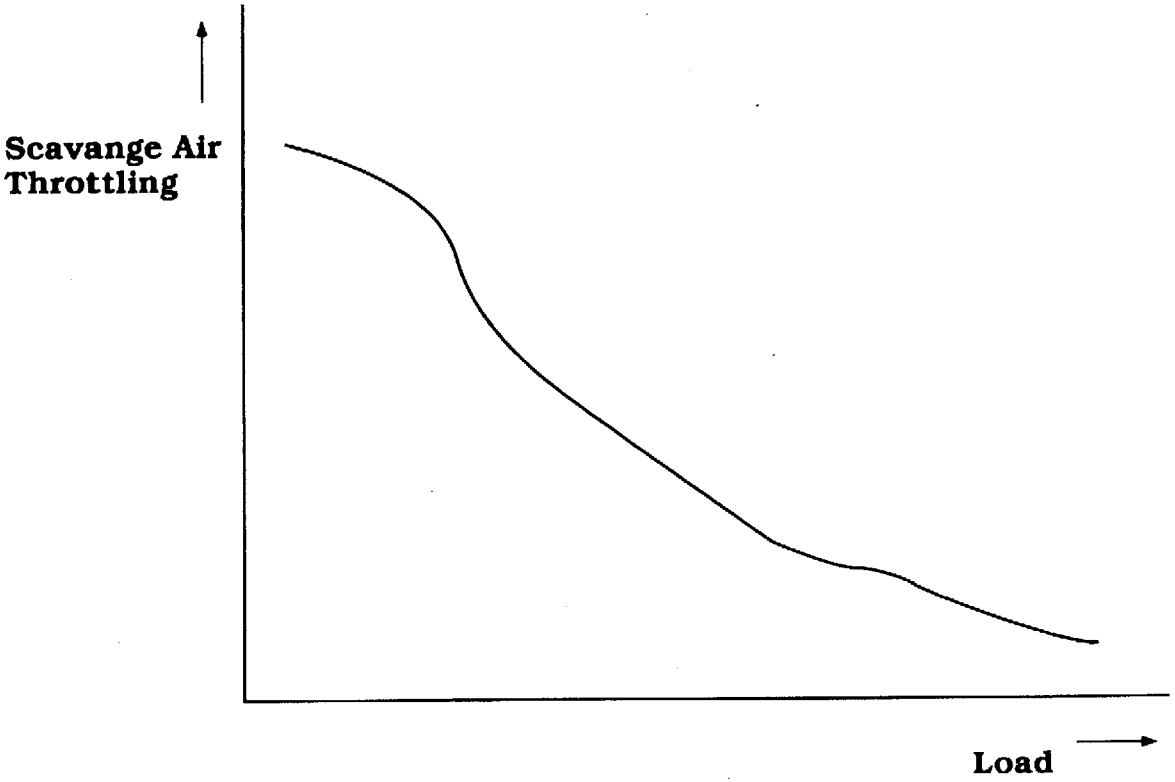
FIG. 6 is a graphical view showing the scavenge throttle amount in relation to engine load in accordance with the illustrated embodiments.

As shown in FIG. 6, the throttling of the scaveng air will be decreased as the load increases so as to minimize this effect when operating at high speed in high load. The actual sequence of opening the scavenge control valves 53, 54, and 55 may be tailored to suit the desired flow pattern in the combustion chamber. That is, the scavenge valves 53, 54 and 55 may be operated either simultaneously or sequentially as should be readily apparent to those skilled in the art so as to provide the desired flow pattern.

Figure 7:
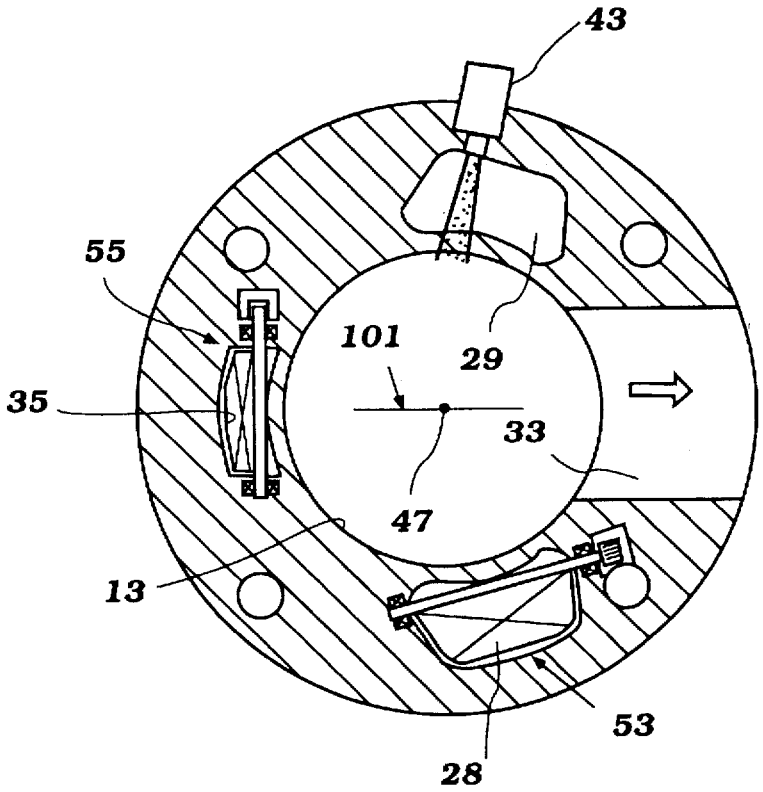
FIG. 7 is a cross-sectional view, in part similar to FIG. 2, and shows another embodiment of the invention.

In the embodiments thus far described, the fuel injector 43 has been positioned so as to spray into the added tumble passage 39. It is to be understood, however, that the invention can be also utilized in conjunction with engines which do not have such a ramble passage. FIG. 7 show such an embodiment.

In this embodiment, the fuel injector 43 is positioned in the main scavenge passage 29 and sprays in a direction generally perpendicularly to a plane 101 that contains the cylinder bore axis 47. In this embodiment, therefore, there is not provided a scavenge control valve in this passage 29. However, the scavenge control valves 53 and 55 associated with the scavenge passages 28 and 35 are retained.

Like the previously described embodiment, when the engine is running at lower speeds and loads, the scavenge control valves 53 and 55 are closed. As a result, there will be a greater air flow velocity through the scavenge passage 29 and the fuel injected by the injector 43 will be better vaporized. In addition, the flow pattern in the cylinder bore 13 will be asymmetric in this condition and away from the exhaust port 33 so as to ensure what fuel will not pass out of the exhaust port. In addition, the stratification will be improved and the fuel will be congregated at the spark plug 45 at its time of firing.

The invention as thus far described has been illustrated in conjunction with engines having fuel injection. The invention, however, may also be employed with engines that have carburetors and FIGS. 8 and 9 show the application of this concept to carburated engines.

In this embodiment, a carburetor, indicated generally by the reference numeral 151 is provided in the intake port 24 serving the crank case chamber 23 upstream of the check valve 27. The carburetor 151 has suitable fuel discharge circuits and includes a flow controlling throttle valve 152.

In this embodiment, a scavenge control valve 53 is provided only in the scavenging port 28. As may be seen, the flow path 32-1 and 32-2 from the scavenge ports 28 and 29 are as previously described. In a like manner, the scavenge flow path 38 from the scavenge passage 35 is also the same. Under normal conditions, these result in a flow vector, indicated generally by the reference numeral 153 that is normal to the plane 49 that contains the cylinder bore axis 47. However, by closing the scavenge control valve 53, this flow vector is shifted as seen at 153-S so as to be directed away from the exhaust port 33 and asymmetrically around the cylinder bore so as to achieve the aforenoted results.

Figure 8:
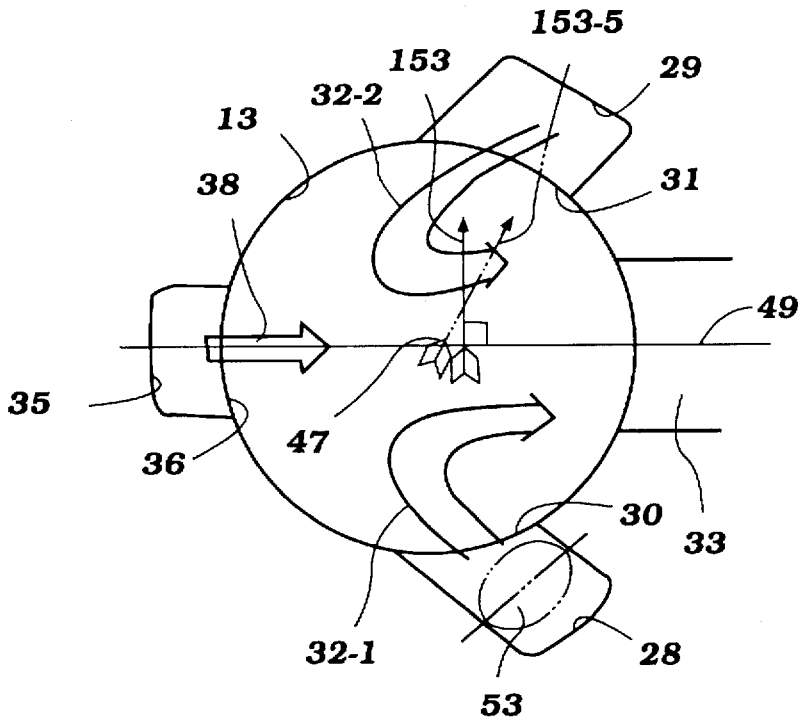
FIG. 8 is a view looking in the same direction as FIGS. 2 and 7 and shows another embodiment of the invention.
Figure 9:
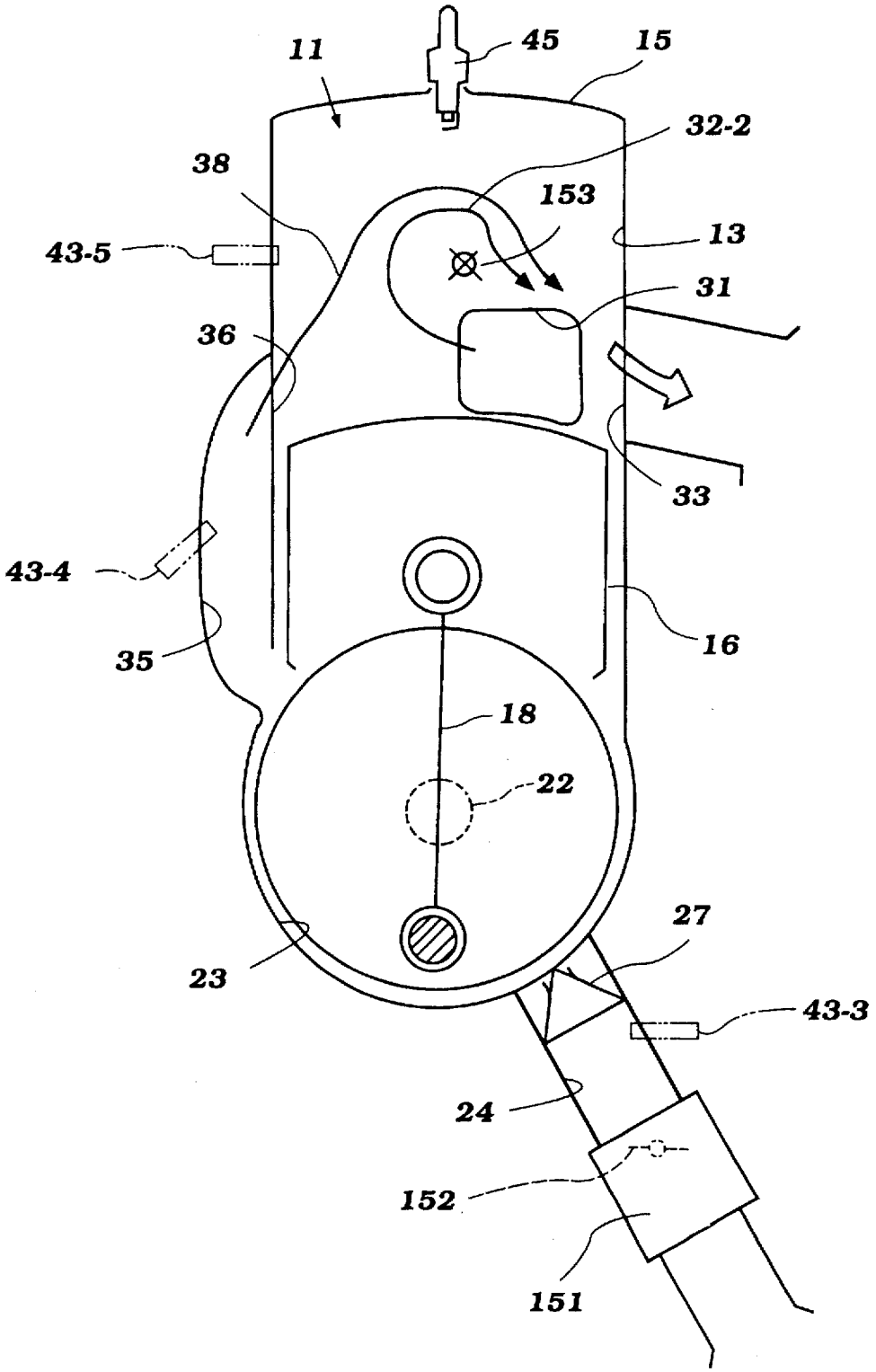
FIG. 9 is a partially schematic view, in part similar to FIG. 1, for this other embodiment of the invention.

FIGS. 8 and 9 also show alternative arrangements for positioning of the fuel injector 43. In one position 43-3, the injector is positioned in the intake port 24. Alternatively and as shown at 43-4, the injector may be positioned in the scavenge passage 35. In either event, the injector is provided so that it is not in the passage where the flow control valve resides. The injector may also be positioned as shown at 43-5 so as to intersect the cylinder bore.

Thus, from the foregoing description it should be readily apparent that the described embodiments of the invention provide good scavenge control for the engine so as to ensure that the fuel will be well vaporized due to high flow velocities even under low speed low load conditions. In addition, the stratification is achieved under all difficult running conditions.

Of course, the foregoing description is that of preferred embodiments of the invention, and various changes and modifications may be made without departing from the spirit and scope of the invention, as defined by the appended claims.

What is claimed is:

1. A two-cycle internal combustion engine having a cylinder block defining a cylinder bore, a piston reciprocating in said cylinder bore, an exhaust port formed in one side of said cylinder bore and opened and closed by the reciprocation of said piston, scavenge passage means formed in said cylinder bore and configured so as to create a scavenging air flow that moves axially along said cylinder bore toward said cylinder head, across said cylinder bore, and down said cylinder bore toward said exhaust port, and control means for controlling the volume and changing the direction of the scavenging air flow into said combustion chamber.

2. A two-cycle engine as set forth in claim 1, wherein the scavenge passage means comprises at least two scavenge passages each opening into said cylinder bore at different locations relative to the exhaust port.

3. A two-cycle engine as set forth in claim 2, wherein the control means comprises a flow control valve that controls the flow through only one of the two scavenge passages.

4. A two-cycle engine as set forth in claim 3, further including a charge former for introducing fuel into the cylinder bore.

5. A two-cycle engine as set forth in claim 4, wherein the charge former introduces fuel through at least one of the scavenge passages.

6. A two-cycle engine as set forth in claim 5, wherein the charge former introduces fuel through the scavenge passages that does not have the flow control valve.

7. A two-cycle engine as set forth in claim 1, wherein the scavenge passage comprises a pair of scavenge passages positioned on opposite sides of the exhaust port.

8. A two-cycle engine as set forth in claim 7, further including a tumble port disposed in the area between the scavenge passages for introducing a tumble motion to the scavenge flow.

9. A two-cycle engine as set forth in claim 8, wherein the control means comprises a flow control valve that controls the flow through only the two scavenge passages.

10. A two-cycle engine as set forth in claim 9, further including a charge former for introducing fuel into the cylinder bore.

11. A two-cycle engine as set forth in claim 10, wherein the charge former introduces fuel through the ramble passage.

12. A two-cycle engine as set forth in claim 11, wherein the tumble port is disposed closer to one of the scavenge passages than to the exhaust port.

13. A two-cycle engine as set forth in claim 9, further including a center scavenge passage disposed in the area between the first-mentioned scavenge passages and on diametrically opposite sides of the cylinder bore, the flow through said center scavenge passage being directed axially along the cylinder bore toward the cylinder head and then across the cylinder bore toward the side thereof where the exhaust port is positioned and then axially downwardly toward said exhaust port and including a flow control valve in said center scavange passage.

14. A two-cycle engine as set forth in claim 13, wherein the center scavenge passage is positioned diametrically opposite to the exhaust port.

15. A two-cycle engine as set forth in claim 13, wherein the tumble port disposed in the area between the center scavenge passage and the exhaust port.

16. A two-cycle engine as set forth in claim 15, further including a charge-forming device for introducing a fuel-air charge into the combustion chamber in proximity to the generated ramble flow.

17. A two-cycle engine as set forth in claim 16, wherein the charge-forming device delivers fuel to the combustion chamber through the tumble port.

* * * * *